US007861878B2

(12) United States Patent
Escarpa Gil

(10) Patent No.: US 7,861,878 B2
(45) Date of Patent: Jan. 4, 2011

(54) FASTENING DEVICE FOR FOLDING BOXES

(75) Inventor: Julián Escarpa Gil, Aldaia (ES)

(73) Assignee: SP Berner Plastic Group S.L., Aldaia (Valencia) (ES)

( * ) Notice: Subject to any disclaimer, the term of this patent is extended or adjusted under 35 U.S.C. 154(b) by 604 days.

(21) Appl. No.: 11/601,741

(22) Filed: Nov. 20, 2006

(65) Prior Publication Data

US 2007/0145053 A1 Jun. 28, 2007

(30) Foreign Application Priority Data

Dec. 27, 2005 (ES) ..... 200503207

(51) Int. Cl.
*B65D 6/00* (2006.01)
*B65D 8/04* (2006.01)
*B65D 8/14* (2006.01)

(52) U.S. Cl. ..... 220/7; 220/4.28; 220/6; 220/691

(58) Field of Classification Search ..... 220/4.28, 220/6, 7, 682, 691
See application file for complete search history.

(56) References Cited

U.S. PATENT DOCUMENTS

| | | | | |
|---|---|---|---|---|
| 3,987,945 | A | 10/1976 | McDowell | |
| 5,632,392 | A | 5/1997 | Oh | |
| 5,967,356 | A | 10/1999 | Laarhoven et al. | |
| 6,290,081 | B1 * | 9/2001 | Merey | 220/7 |
| 6,293,418 | B1 | 9/2001 | Ogden et al. | |
| 6,772,897 | B2 | 8/2004 | Kellerer et al. | |
| 6,843,386 | B2 * | 1/2005 | Raghunathan et al. | 220/7 |
| 7,011,225 | B2 * | 3/2006 | Oster et al. | 220/7 |
| 2003/0006232 | A1 | 1/2003 | Raghunathan et al. | |
| 2003/0146213 | A1 | 8/2003 | Kellerer et al. | |
| 2004/0129700 | A1 | 7/2004 | Oster et al. | |

FOREIGN PATENT DOCUMENTS

| | | |
|---|---|---|
| AU | 4400300 | 11/2000 |
| CA | 2216121 | 7/1997 |
| CA | 2273556 | 11/2000 |

(Continued)

OTHER PUBLICATIONS

International Search Report issued May 11, 2007 in International (PCT) Application No. ES2006/000707.

*Primary Examiner*—Anthony Stashick
*Assistant Examiner*—Madison L Wright
(74) *Attorney, Agent, or Firm*—Wenderoth, Lind & Ponack, L.L.P.

(57) ABSTRACT

A fastening device for folding boxes, the folding boxes including a bottom and four lateral walls coupled in jointed fashion to the edges of that bottom, two opposite walls having each fastening devices for ensuring the unfolding of the box, the device in general including a vertically displaceable central piece and some lateral bolts with horizontal displacement for fastening the lateral walls via their adjacent edges. The folding device includes elastic spring elements which link the central control piece with the pairs of bolts, at the same time, the spring elements, in the rest position, maintain the bolts in the engagement and fastening position of the bolts, while for the release position of the bolts the spring elements pull the bolts towards the release position against the resistance of the elastic elements.

15 Claims, 3 Drawing Sheets

FOREIGN PATENT DOCUMENTS

| | | |
|---|---|---|
| CA | 2309234 | 11/2000 |
| CA | 2327942 | 6/2001 |
| DE | 19917771 | 11/2000 |
| EP | 1655232 A1 | 5/2006 |
| ES | 2169280 | 7/2002 |
| ES | 1055832 | 1/2004 |
| ES | 2212893 | 8/2004 |
| WO | 00/63084 | 10/2000 |
| WO | 00/68099 | 11/2000 |

* cited by examiner

FASTENING DEVICE FOR FOLDING BOXES

BACKGROUND OF THE INVENTION

I. Field of the Invention

As stated in the title of this descriptive specification, the present invention relates to a fastening device for folding boxes, essentially of a plastic material and which possess a base, on whose edges the lateral walls are coupled in jointed fashion in such a way that two opposite lateral walls incorporate the fastening device which ensures the connection and assembly of the four lateral walls.

So, starting from this premise, the objective of the invention is a fastening device that is simple and easy to use, but secure and very practical, which permits the simultaneous disengagement of the two fastening devices associated with the two opposite walls, at the same time that the box is handled by being held with the hands when they are introduced into openings by way of handles which incorporate at least the lateral walls fitted with the fastening devices.

II. Description of the Related Art

Boxes made of a plastic material are currently known, among which are to be found those containing folding lateral walls jointed at the edges of their base or bottom, in such a way that when the boxes are not being used, those walls can be collapsed towards the interior in horizontal planes parallel to the bottom of the box.

Moreover, the lateral walls possess means of fastening in their pairs of adjacent walls in order to secure the assembly of the boxes during their use. On the other hand, when the boxes are empty, those fastenings are released so that the lateral walls can be collapsed and thus reduce the volume to a minimum space, which is very practical during storage and transport of empty boxes, for example.

An example this type of box is utility model No. 200302479, Publication No. 200201794 in which fastenings are used which rise and fall vertically in order to achieve the assembly and release of the lateral walls in correspondence with adjacent edges of their lateral walls.

Other boxes exist in which the fastenings are displaced horizontally in opposite directions, in one case towards the centre of the lateral walls in order to release the fastenings and towards the outside in order to secure the assembly of the box in the unfolded position so that it can then be filled with some product.

In these cases, the fastenings are similar to the sliding latch of a conventional lock. It has been demonstrated in practice that this type of horizontal fastening with displacements in opposite directions offers greater security than the former boxes which use the fastening with vertical displacement (see utility model No. 200302479 and Publication No. 200201794).

Examples of this type of fastening with horizontal displacement are documents U.S. Pat. No. 6,293,418, CA 2309234, CA 2273556, U.S. Pat. No. 3,987,945, U.S. Pat. No. 5,632,392, ES 2169280, U.S. Pat. No. 6,772,897.

In some of these documents, for example, U.S. Pat. No. 5,632,392 and ES 2169280, each of the locks needs to be individually operated, which prevents them from being simultaneously operated with just one hand.

However, U.S. Pat. No. 6,293,418 does indeed provide for an embodiment in which the operating device and fastening elements are a single piece (FIGS. 10 and 11), such that, when operating on a central zone 196a, an elastic deformation would take place pulling on some end sections and simultaneously releasing two end locks or fastenings.

Publication No. 200201794, also possesses a single-piece device with pairs of end fastenings which are simultaneously displaced when the device is centrally operated by a single hand, though the fastenings are, however, vertical operation rather than horizontal as occurs with the majority of the cited boxes and also in the invention that we are concerned with.

SUMMARY OF THE INVENTION

With the aim of achieving the objectives and avoiding the drawbacks mentioned in the above sections, the invention proposes a fastening device for folding boxes included among those that can be operated with a single hand with disengagement of pairs of locks, but based on fastenings which are horizontally operated by means of pairs of locks with bolts, rather than being vertically operated as occurs in Publication No. 200201794, where the fastenings of the bolts are vertically operated, this being a fundamental difference.

This type of box in general comprises a rectangular base whose edges are coupled in jointed fashion to two larger or side lateral walls and two lesser or end lateral walls, in such a way that in the unfolded or assembled position of the box, the adjacent edges of the lateral walls become engaged together by means of pairs of bolts forming part of the fastening device in correspondence with each end, such that when a central control piece is displaced vertically in one direction by the hand, the bolts release the engagement of the ends with respect to the sides so that the lateral walls can be collapsed and the box can thus be folded, with the bolts recovering their initial position afterwards when the central piece is ceased to be acted on.

Starting from this premise, the fastening device is characterised in that it includes some spring elements which have a dual function.

First of all, the spring elements associate the pairs of horizontal displacement bolts with the central control piece, so that when the central control piece is displaced upwards, the pairs of bolts are displaced and horizontally retracted in opposite directions towards the centre of the end walls. Additionally, when the central control piece is ceased to be acted upon the bolts recover their initial rest position by being displaced towards the outside by the spring elements, this latter being the second function of the springs.

Each of the springs is in turn characterised in that it consists of or includes a structure with two angular end bends, an upper one which connects with one end of the bolts opposite to the engagement end and a lower bend which connects with the central control piece, in such a way that when the control piece is displaced upward, the elastic spring elements are deformed and accumulate elastic energy so that when the control pieces are ceased to be acted on, the control pieces and the bolts recover their initial rest position due to the elastic energy accumulated in the spring elements.

Moreover, the spring elements include certain narrow bodies, though they could have any other structure and could even be independent elements or forming an integral body together with the control piece and the pairs of bolts.

Other characteristics of the invention are that both the central control piece and the pairs of bolts are guided in pairs of continuous ribs.

Moreover, the bolts engage via their exterior end sections in complementary cavities established in the end edges of the side walls.

Below, in order to facilitate a better understanding of this descriptive specification and forming an integral part thereof, figures are attached in which, by way of illustration only and not limiting, the object of the invention has been represented.

DETAILED DESCRIPTION OF THE INVENTION

Figure 1:
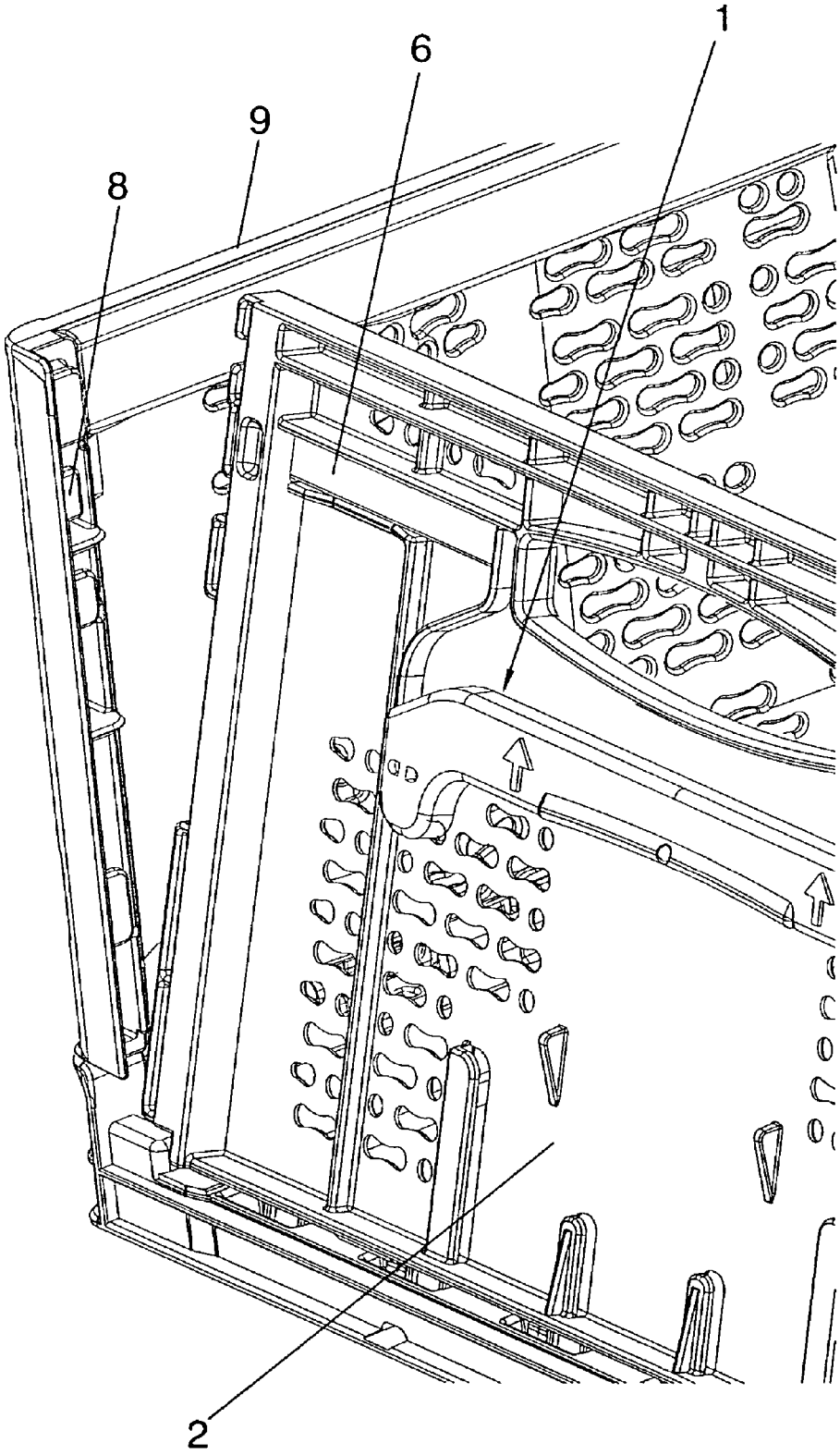
FIG. 1.—Shows a perspective view of a part of the folding box that incorporates the fastening device, forming the object of the invention.
Figure 2:
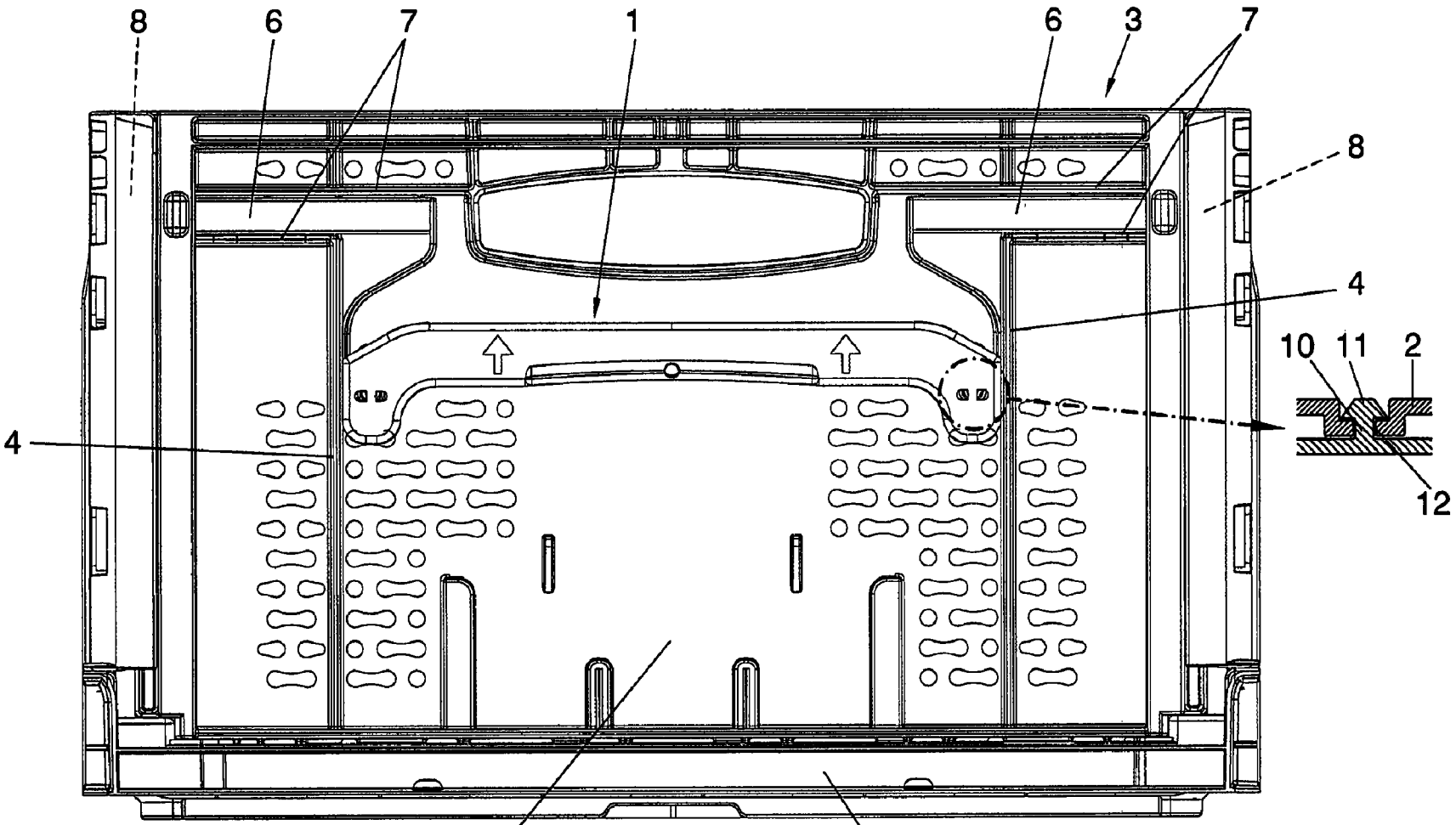
FIG. 2.—Represents a front view of the box, showing the fastening device of the invention in the engaged position.
Figure 3:
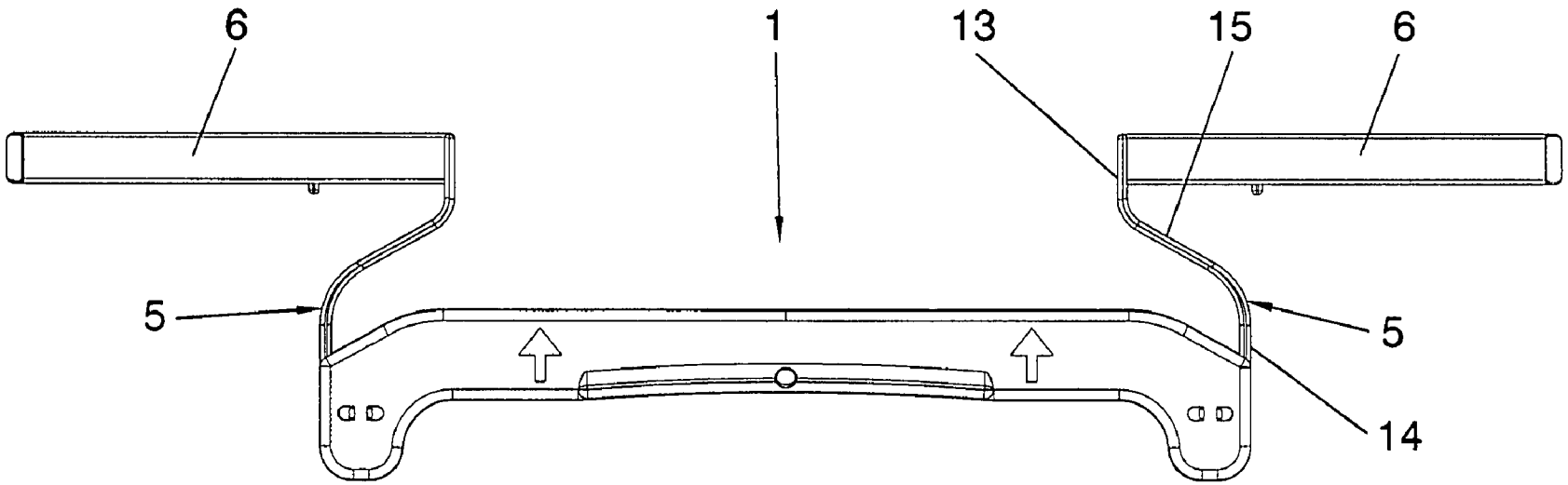
FIGS. 3 and 4—Represent some views of a central control piece forming part of the fastening device.
Figure 4:
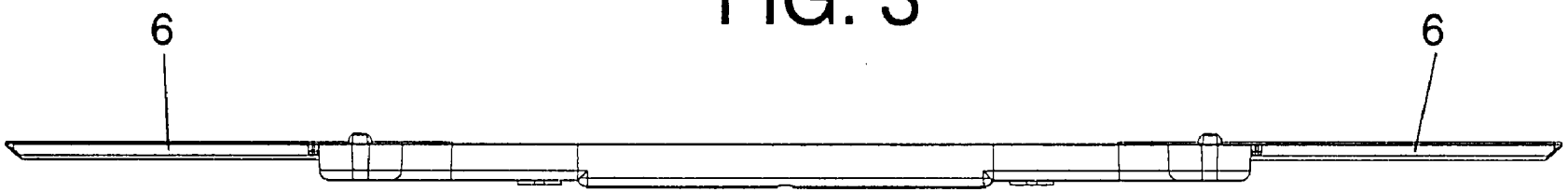

Considering the numbering adopted in the figures, the fastening device for folding boxes is defined on the basis of a central control piece 1 coupled in each of the end walls 2 of a box 3, at the same time as it is guided between two vertical ribs 4 integral with end walls 2, so that the central piece 1 can thus slide is in the vertical direction.

Arising from the ends of the central control piece 1 are two elastic spring elements 5 which are in turn joined to pairs of bolts 6 aligned in the same horizontal direction and guided in other pairs of ribs 7, in such a way that the end sections of ribs 6 are the portions that fit into some cavities 8 of the ends of the side walls 9 of the boxes in the unfolded or assembled position of the box 3.

The central control piece 1 possesses certain short frontal extensions 10 with some thickenings 11 at the end which fit into complementary grooves 12 of the end walls 2 in order to secure the linkage of the central pieces 1 of other elements joined to them to the respective end wall 2.

In a preferred embodiment, the central control piece 1, pairs of elastic springs 5, pairs of bolts 6, extensions 10 and thickenings 11 all constitute elements of a single integral body.

Basically, each elastic spring element 5 comprises two end portions 13 and 14 joined to the respective bolt 6 and central control piece 1, and an inclined central section 15 which forms an obtuse angle with respect to the end portions 13 and 14.

The lateral walls, sides 9 and ends 2, are coupled in a jointed fashion to the edges of the base or bottom 16 of the box 3.

With this arrangement described, when we displace the control piece 1 upwards, the spring elements 5 deform and accumulate elastic energy, and they pull the bolts towards the centre of the end wall, thereby releasing the linkage with the lateral wall of the box, so that those walls can then be collapsed in order to fold the box.

Afterwards, when the central control pieces 1 are ceased to be acted on, both the central control pieces 1 and the springs 5 and bolts 6 recover their initial position due to the elastic energy of the springs 5.

When it comes to carrying out the unfolding, first, the side walls are opened out and then the end walls, in such a way that close to the fully unfolded position of the end walls, the control piece 1 is acted upon displacing it upwards at the moment the opening out is completed, in order to finally release the control piece, with which the bolts are introduced into the cavities on the end edges of the lateral walls, the box thus becoming fully assembled and unfolded.

The invention claimed is:

1. A fastening device for folding boxes, said boxes comprising a base or bottom with parallel edges two by two and four folding lateral walls coupled in jointed fashion to edges of the base, the four lateral walls including first and second end walls and first and second side walls, the first and second ends walls being opposite each other, said fastening device comprising:

first and second vertically displaceable central control pieces incorporated into the first and second end walls, respectively, each vertical displaceable central control piece having short frontal extensions with thickenings at the ends thereof, said short frontal extensions being configured to fit into complementary grooves of a respective end wall to secure each said central control piece to the respective end wall, and each said vertically displaceable central control piece being associated with a pair of horizontal operating bolts, each said pair of horizontal operating bolts being arranged such that in a first position, each said pair of horizontal operating bolts fastens the respective end wall to the first and second side walls at adjacent edges, while in a second position the fastening is released in order to be able to collapse the four lateral walls;

wherein each said vertical displaceable central control piece is guided and fits between two vertical ribs integrally disposed in the respective end wall and includes certain elastic spring elements which link each said central control piece with said pair of bolts to which each said central control piece is associated, for each said vertical displaceable central control piece, said spring elements are configured to maintain said pair of bolts in an engagement and fastening position of said pair of bolts when at rest, while a release position of said pair of bolts being when said central control piece has been displaced upwards, said spring elements being configured to pull said bolts towards the release position accumulating elastic energy which presses said pair of bolts towards the engagement and fastening position; and wherein each said vertical displaceable central control piece extends in a longitudinal direction, and for each said vertical displaceable central control piece, each frontal extension of said frontal extensions extends from said vertical displaceable central control piece in a direction substantially perpendicular to the longitudinal direction of said vertical displaceable central control piece.

2. A fastening device for folding boxes according to claim 1, wherein for each said central control piece, said elastic spring elements constitutes a single integral body together with said central control piece and said pair of bolts.

3. A fastening device for folding boxes according to claim 1, wherein or each said central control piece, said elastic spring elements comprise independent bodies joined via end sections thereof to said central control piece and said pair of bolts.

4. A fastening device for folding boxes according to claim 1, wherein each elastic spring element comprises a first end portion and a second portion opposing said first end portion, said first and second end portions of each said elastic spring element joined to one bolt of said pair of bolts and said central control piece, respectively, each said elastic spring element comprising a central section which forms an obtuse angle with respect to said opposing first and second end portions.

5. A fastening device for folding boxes according to claim 4, wherein for each said spring element, said central section and said first and second end portions of said elastic spring element are joined in a rounded manner.

6. A fastening device for folding boxes according to claim 1, wherein each said pair of bolts fits into and is guided between a pair of horizontal ribs integral with the respective end wall.

7. A fastening device for folding boxes according to claim 2, wherein each elastic spring element comprises a first end portion and a second end portion opposing said first end portion, said first and second end portions of each said elastic spring element joined to one bolt in said pair of bolts and the central control piece, respectively, each said elastic spring element comprising a central section which forms an obtuse angle with respect to said opposing first and second end portions.

8. A fastening device for folding boxes according to claim 3, wherein each elastic spring element comprises a first end portion and a second end portion opposing said first end portion, said first and second end portions of each said elastic spring element joined to one bolt in said pair of bolts and the central control piece, respectively, said elastic spring element comprising a central section which forms an obtuse angle with respect to said opposing first and second end portions.

9. A fastening device for folding boxes according to claim 2, wherein each said pair of bolts fits into and is guided between a pair of horizontal ribs integral with the respective end wall.

10. A fastening device for folding boxes according to claim 3, wherein each said pair of bolts fit into and are guided between a pair of horizontal ribs integral with the respective end wall.

11. A fastening device for folding boxes according to claim 4, wherein each said pair of bolts fits into and is guided between a pair of horizontal ribs integral with the respective end wall.

12. A fastening device for folding boxes according to claim 5, wherein each said pair of bolts fits into and is guided between a pair of horizontal ribs integral with the respective end wall.

13. A fastening device for folding boxes according to claim 5, wherein each said central control piece is guided and fits between two vertical ribs integral with the respective end wall.

14. A fastening device for folding boxes according to claim 6, wherein each said central control piece is guided and fits between two vertical ribs integral with the respective end wall.

15. A fastening device for folding boxes according to claim 1, wherein each of the short frontal extensions includes a cylindrical stem having an outer surface, and the thickening for each short frontal extension being a trapezoidal cylindrical thickening, the trapezoidal cylindrical thickening being positioned on a distal end of the cylindrical stem and having a diameter that is greater than the diameter of the outer surface of the stem.

* * * * *